US007541998B1

(12) United States Patent
Chang et al.

(10) Patent No.: US 7,541,998 B1
(45) Date of Patent: Jun. 2, 2009

(54) CIRCULARLY-POLARIZED DIELECTRIC RESONATOR ANTENNA

(75) Inventors: Tze-Hsuan Chang, Taipei (TW); Jean-Fu Kiang, Taipei (TW)

(73) Assignee: National Taiwan University, Taipei (TW)

( * ) Notice: Subject to any disclaimer, the term of this patent is extended or adjusted under 35 U.S.C. 154(b) by 34 days.

(21) Appl. No.: 11/959,695

(22) Filed: Dec. 19, 2007

(30) Foreign Application Priority Data

Nov. 20, 2007 (TW) ..... 96143885 A

(51) Int. Cl.
*H01Q 13/00* (2006.01)

(52) U.S. Cl. ..... 343/767

(58) Field of Classification Search ..... 343/767, 343/700 MS, 702, 846–848, 829
See application file for complete search history.

(56) References Cited

U.S. PATENT DOCUMENTS 6,147,647 A 11/2000 Tassoudji et al.
6,452,565 B1 * 9/2002 Kingsley et al. ..... 343/873
6,879,287 B2 * 4/2005 Popov et al. ..... 343/700 MS
6,900,764 B2 * 5/2005 Kingsley et al. ..... 343/700 MS
6,940,463 B2 * 9/2005 Ittipiboon et al. ..... 343/729
6,995,713 B2 2/2006 Le Bolzer et al.
7,009,565 B2 * 3/2006 Pidwerbetsky et al. ..... 343/700 MS
7,196,663 B2 3/2007 Bolzer et al.
7,504,721 B2 * 3/2009 Chen et al. ..... 257/724

* cited by examiner

*Primary Examiner*—Huedung Mancuso
(74) *Attorney, Agent, or Firm*—Rabin & Berdo, P.C.

(57) ABSTRACT

The present invention relates to a circularly-polarized dielectric resonator antenna (DRA). The antenna comprises a substrate, a Wilkinson power divider, a phase shifter, a ground plane and a dielectric resonator, wherein the phase shifter is connected to the Wilkinson power divider. Besides, the dielectric resonator is disposed on the ground plane, and includes a dielectric main body and a slot disposed above the substrate. Additionally, the antenna is adopted to increase the linear radiation bandwidth by utilizing the slot, and transceivers a circularly-polarized electromagnetic wave by utilizing the Wilkinson power divider. Consequently, the circularly-polarized dielectric resonator antenna can be applied in the fields of satellite communication, Worldwide Interoperability for Microwave Access (WiMAX), and wireless communication.

8 Claims, 8 Drawing Sheets

CIRCULARLY-POLARIZED DIELECTRIC RESONATOR ANTENNA

FIELD OF THE INVENTION

The present invention relates to an antenna, and more particularly, to a circularly-polarized dielectric resonator antenna (DRA), applied in the fields of satellite communication, Worldwide Interoperability for Microwave Access (WiMAX), and wireless communication.

BACKGROUND OF THE INVENTION

Two types of polarization of antenna are frequently used, linear polarization (LP) and circular polarization (CP). When wave of CP is used for satellite communication, it is less sensitive through ionosphere than the LP wave in terms of polarization; hence it is applied in satellite and other wireless systems like GPS to become the design trend of the recent research, development and application.

DRA is usually operated in a $TE_{111}$ mode, and the mode has a wide beam linearly-polarized radiation pattern with a bandwidth of approximately 5-8% and having advantages of low loss and high radiation efficiency. In a common circularly-polarized DRA, an oblique aperture can be used to excite two modes with mutually orthogonal electric fields, to radiate circularly-polarized wave. Alternatively, a metal sheet is adhered to the surface of the dielectric resonator of the antenna, to perturb its original electric field distribution to generate two mutually orthogonal electric fields and generate the circular polarization. Alternatively, an annular or U-shaped aperture is used to excite the circularly-polarized electromagnetic wave from the dielectric resonator, but the bandwidth having an axial ratio (AR) smaller than 3 dB is approximately 3%, which has a much smaller bandwidth as compared with a common linearly-polarized DRA which can reach 5-8% of bandwidth. The linearly-polarized bandwidth of the DRA is mainly affected by the dielectric constant of the antenna and the shape thereof, and generally, if a material with lower dielectric constant (e.g., ∈γ□10) is used, the bandwidth can be improved by about 10%.

U.S. Pat. No. 6,147,647 B1 published on Nov. 14, 2000, titled "Circularly polarized dielectric resonator antenna" disclosed a dual-band dielectric resonator antenna, comprising: a first resonator formed of a dielectric material; a first ground plane formed of a conductive material on which said first resonator is mounted; a second resonator formed of a dielectric material; a second ground plane formed of a conductive material on which said second resonator is mounted, said first and second ground planes being separated from each other by a predetermined distance; and first and second probes electrically coupled to each of said resonators spaced approximately 90 degrees apart around the perimeter of each resonator providing first and second signals, respectively, to each resonator, wherein each of said resonators resonates in a predetermined frequency band that differs between said resonators Additionally, U.S. Pat. No. 6,995,713 B1 published on Feb. 7, 2006, titled "Dielectric resonator wideband antenna" disclosed a wideband antenna consisting of a dielectric resonator or DRA mounted on a substrate with a ground plane. The resonator is positioned at a distance x from at least one of the edges of the ground plane, x being chosen such that 0.1 toreq.x.ltoreq . . . Lamda . . . sub. die ½, with .lamda . . . sub. die ½ the wavelength is defined in the dielectric resonator.

Also, U.S. Pat. No. 7,196,663 B1 published on Mar. 27, 2007, titled "Dielectric resonator type antennas" disclosed a dielectric resonator antenna comprising a block of dielectric resonator having a first face intended to be mounted on ground plane and entirely covered with a first metallic layer, wherein at least one second face perpendicular to the first face is covered with a second metallic layer contacting said metallic layer covering said first face, said second metallic layer covering said second face extending over a width less than the width of the second face and over a height less than or equal to the height of the second face, and wherein said block of dielectric resonator comprises a third face being at least partially unbounded by conductive material so as to emit radiation from said third face.

However, above-mentioned DRAs, for example U.S. Pat. No. 6,147,647 "Circularly polarized dielectric resonator", U.S. Pat. No. 6,995,713 "Dielectric resonator wideband antenna", and U.S. Pat. No. 7,196,663 "Dielectric resonator type antennas", all related to a rectangle DRA, huge affect will be brought to the wireless communication field, whenever the circular polarization and the bandwidth can not be improved at the same time.

SUMMARY OF THE INVENTION

According to the prior arts mentioned above, the present invention is provided with a wideband circularly-polarized dielectric resonator antenna. The antenna comprises a substrate including a first surface and a second surface; a Wilkinson power divider and a phase shifter are formed on the first surface; a ground plane and a dielectric resonator are formed on the second surface; wherein the phase shifter formed on the first surface and having a main line, a reference line, a first microstrip line, and a second microstrip line, in which input ports of the main line and the reference line are respectively connected to two output ports of the Wilkinson power divider, and the first microstrip line and the second microstrip line are respectively connected to output ports of the main line and the reference line; a ground plane formed on the second surface and having a first hollow portion and a second hollow portion; and a dielectric resonator disposed above the ground plane and including a dielectric main body and a moat.

The antenna further includes a signal input/output device disposed on a side edge of the substrate and the signal connected to the substrate. The Wilkinson power divider includes two output ports respectively connected to the input ports of the main line and the reference line of the phase shifter. The Wilkinson power divider and the phase shifter are combined such that the circularly-polarized DRA generates two $TE_{111}$ modes with the same magnitude and a phase difference of 90° when feeding a signal. The disposed positions of the first microstrip line and the second microstrip line of the phase shifter are respectively extended to correspondingly pass through centers of the first hollow portion and the second hollow portion of the ground plane. The ground plane is made of a conductive material, for example, copper, in which axes of the first hollow portion and the second hollow portion are mutually orthogonal. The dielectric resonator is disposed on the ground plane, and correspondingly above the first hollow portion and the second hollow portion, in which the dielectric main body has a square cross section, the moat is an annular rectangle slot, and dielectric constant of the dielectric resonator is between 10 and 100.

To sum up, there is a rectangular annular slot embedded into the main body of the rectilinear dielectric resonator in present invention, and the resonator is formed to cause a discontinuity such that the electric field in the slot is enhanced, to improve the radiation efficiency and reduce the quality factor, thereby increasing the bandwidth. The Wilkinson power divider and the phase shifter are joined to generate two signals with the same magnitude and a phase difference of 90°. Through an aperture coupling manner, signals are fed into the dielectric resonator to generate the circularly-polarized characteristics.

BRIEF DESCRIPTIONS OF THE DRAWINGS

The foregoing aspects, as well as many of the attendant advantages and features of this invention will become more apparent by reference to the following detailed description, when taken in conjunction with the accompanying drawings, wherein.

DESCRIPTION OF EMBODIMENTS

Figure 1:
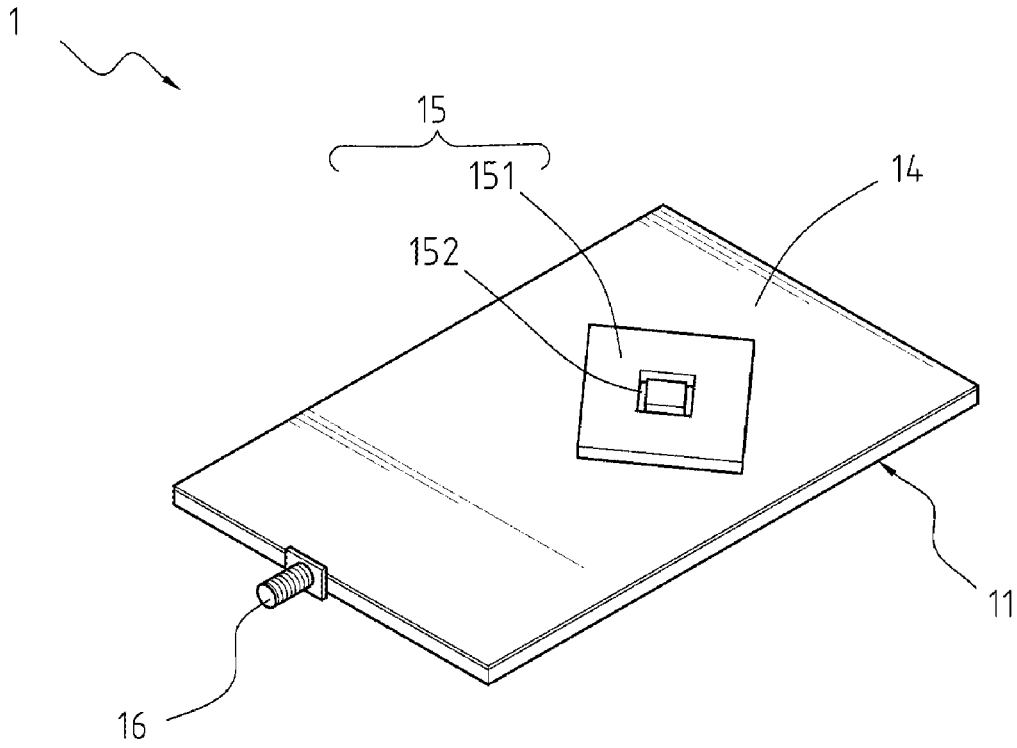
FIG. 1 is a perspective diagram of the circularly-polarized DRA of the present invention.
Figure 2:
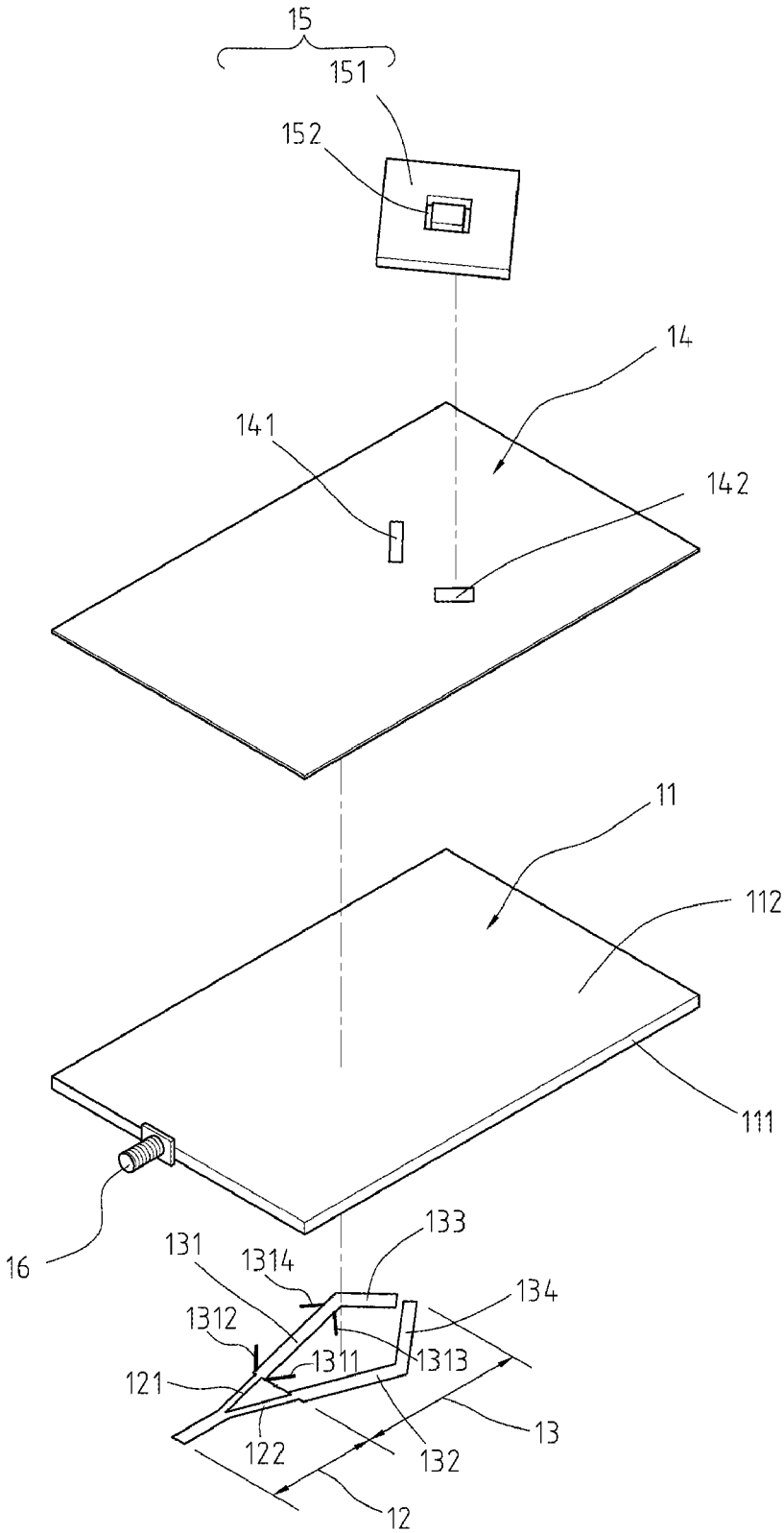
FIG. 2 is a schematic exploded view of the circularly-polarized DRA of the present invention.

Referring to FIGS. 1 and 2, a perspective and a schematic exploded view of the circularly-polarized dielectric resonator antenna of the present invention are respectively illustrated.

The circularly-polarized DRA 1 comprises: a substrate 11 including a first surface 111 and a second surface 112, which is a printed circuit board made of a material having a dielectric constant of 2-13, for example, an FR4 glass fiber board with the dielectric constant of 4.4; a Wilkinson power divider 12 formed on the first surface 111 and having an input port and two output ports, in which the Wilkinson power divider 12 can generate two signals with the same magnitude and a phase difference of 90°; a phase shifter 13 formed on the first surface 111 and connected to the Wilkinson power divider 12, and having a main line 131, a reference line 132, a first microstrip line 133, and a second microstrip line 134, in which input ports of the main line 131 and the reference line 132 are respectively connected to the two output ports (121 and 122) of the Wilkinson power divider 12, and the first microstrip line 133 and the second microstrip line 134 are respectively connected to output ports of the main line 131 and the reference line 132, in which an open-circuit microstrip line 1311 with a quarter wavelength and a short-circuit microstrip line 1312 with a quarter wavelength are connected in parallel at the input port of the main line 131, an open-circuit microstrip line 1313 with a quarter wavelength and a short-circuit microstrip line 1314 with a quarter wavelength are connected in parallel at the output port, and the short-circuit portions are connected to a ground plane 14 through two paths; a ground plane formed on the second surface 112, which can be a metal layer, in which the ground plane 14 further includes a first hollow portion 141 and a second hollow portion 142 that are long-rectangular shaped, and axes of the first hollow portion 141 and the second hollow portion 142 are orthogonal; and a dielectric resonator 15 disposed above the ground plane 14 and including a dielectric main body 151 and a slot 152, in which the dielectric main body 151 is a square or rectangular structure, the dielectric main body 151 is overlapped above the first hollow portion 141 and the second hollow portion 142 of the ground plane 14, and the slot 152 is an annular slit disposed in the main body 151 with a shape of annular rectangle.

The circularly-polarized DRA 1 further includes a signal input/output device 16 disposed on a side edge of the substrate 11, for inputting and outputting signals. The first microstrip line 133 and the second microstrip line 134 of the phase shifter 13 must be disposed to respectively extend to pass through the centers of the first hollow portion 141 and the second hollow portion 142. Next, the material of the dielectric resonator 15 has the characteristics of high dielectric constant and low loss, the range of dielectric constant is between 10 and 100, the loss tangent is usually smaller than 0.005, so as to have the feature of high radiation efficiency. When electric line passes through the slot, the dielectric constant of the dielectric resonator 15 is greater than the dielectric constant of air ($\in\gamma=1$), such that the electric field is enhanced by several times, the electromagnetic wave radiation is made to be more efficient, the quality factor Q is lowered, and the bandwidth of the signal transmission is thus increased.

In addition, the design of the width of the microstrip line of the Wilkinson power divider 12 and the selection of bridged resistance make the fed signal to have no reflection when the two output ends of the Wilkinson power divider 12 match with each other. The design of the width and the length of the microstrip line of the phase shifter make the main line and the reference line to have a phase difference of 90°, the same amplitude, and a minimum return loss at the operating frequency.

Sizes of different parts of the DRA 1 are given as follows. The main body 151 includes a length a, a width b, and a height d. A width of the slot 152 is p, a length of the square dielectric in the slot 151 is $a_1$, and the substrate 11 and the ground plane 14 respectively have a length $W_x$ and a width $W_y$. The phase shifter 13 has a width $W_m$ and is joined with the Wilkinson power divider 12. The first microstrip line 133 and the second microstrip line 134 of the phase shifter 13 respectively extend to exceed the first hollow portion 141 and the second hollow portion 142 by a length $L_s$, and the first hollow portion 141 and the second hollow portion 142 all have a length $L_a$ and a width $W_a$.

In addition, it should be noted that some performance indices of the DRA 1 provided by the present invention can be controlled by adjusting related elements. For example, (1) the position of the dielectric resonator 15 is fine-adjusted to match the input impedance with the input signal line, (2) the size of the main body 151 is adjusted to adjust the radiation frequency of the antenna, and (3) the width of the slot 152 is adjusted to fine-adjust the resonance frequency of the antenna and to increase the radiation bandwidth.

Next, one of the preferred embodiments of the present invention is disclosed as follows, in which size parameters of the main body 151 and the slot 152 of the dielectric resonator are defined to be a=22 mm, b=22 mm, d=4 mm, p=1.55 mm, and $a_1$=22 mm. The lengths and widths of the first hollow portion 141 and the second hollow portion 142 are $W_a$=1 mm and $L_a$=9 mm. The lengths and widths of the substrate 11 and the ground plane 14 are $W_x$=80 mm and $W_y$=60 mm. The thickness of the substrate 11 is t=1.6 mm, the dielectric constant is 4.4, and the dielectric constant $\in\gamma$ of the dielectric resonator 15 is 20.

Subsequently, the length and width of the output end of the Wilkinson power divider are respectively 9.5 mm and 3 mm, and in the phase shifter 13, the length and width of the main line are respectively 20 mm and 2.3 mm, the length and width of the reference line are respectively 27 mm and 3 mm, the length and width of the first microstrip line are respectively 11 mm and 2.3 mm, and the length and width of the second microstrip line are respectively 13.5 mm and 3 mm. Further, the length of the first microstrip line 133 and the second microstrip line 134 exceeding the first hollow portion 141 and the second hollow portion 142 is $L_s$=3 mm.

Figure 3:
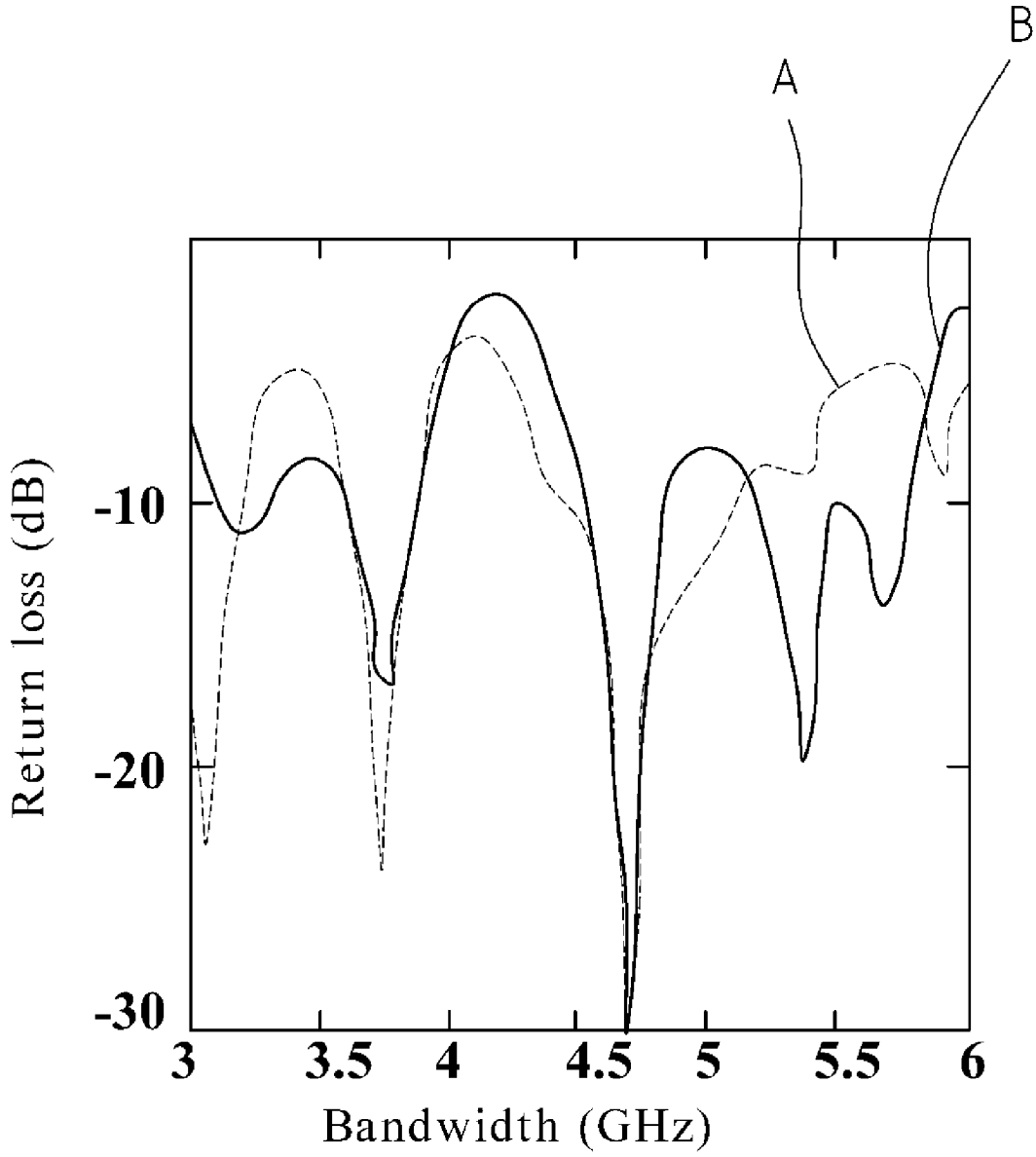
FIG. 3 is a diagram illustrating return loss of the signal radiation of the circularly-polarized DRA according to the embodiment of the present invention.

FIG. 3 is a diagram of return loss of the signal radiation of the embodiment, showing the simulation result and practical measurement of the return loss of the signal radiation, in which dashed line represents a result of simulating the return loss A of the signal radiation, and solid line represents a result of practically measuring the return loss B of the signal radiation. When the return loss is 10 dB, the signal radiation band is between 4.43 GHz and 5.85 GHz.

Figure 4:
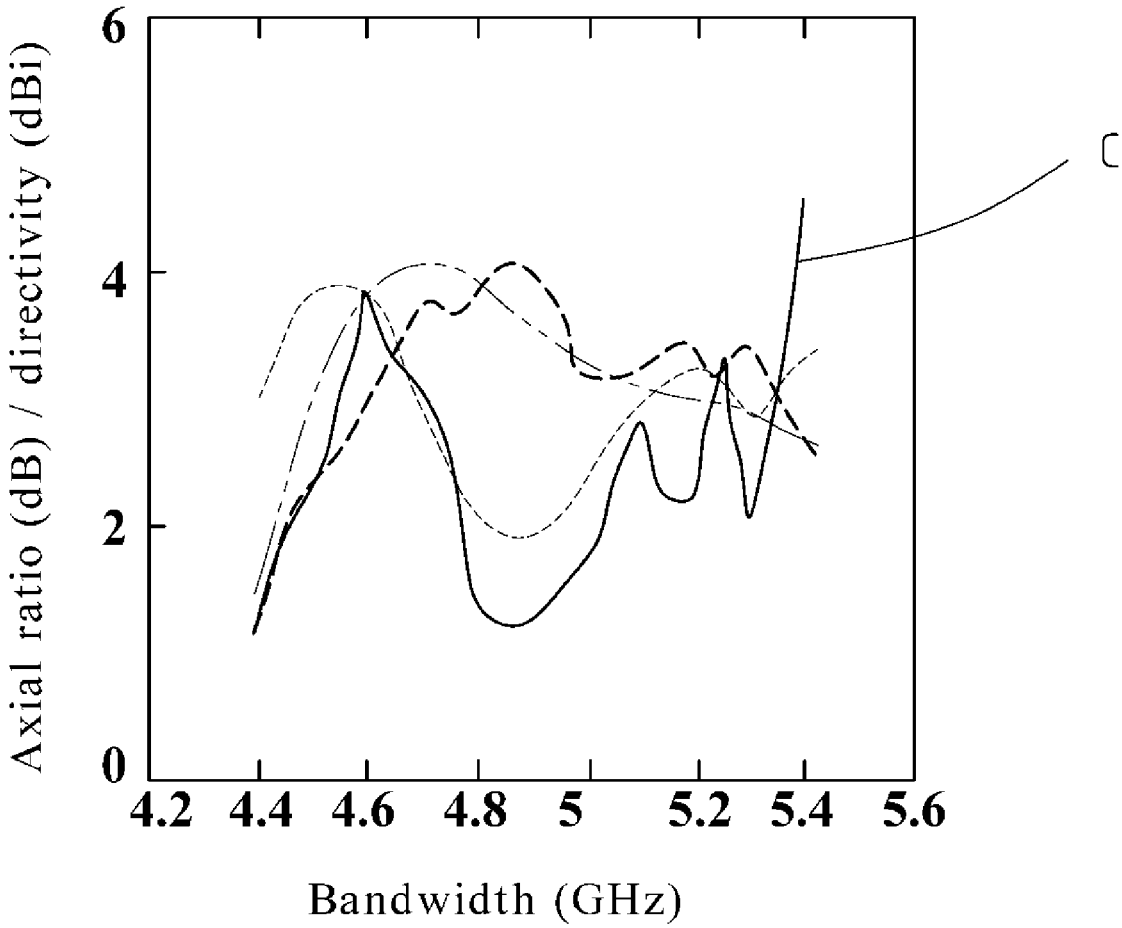
FIG. 4 is a diagram of directivity and AR of the antenna radiation of the circularly-polarized DRA according to the embodiment of the present invention.
Figure 5A:
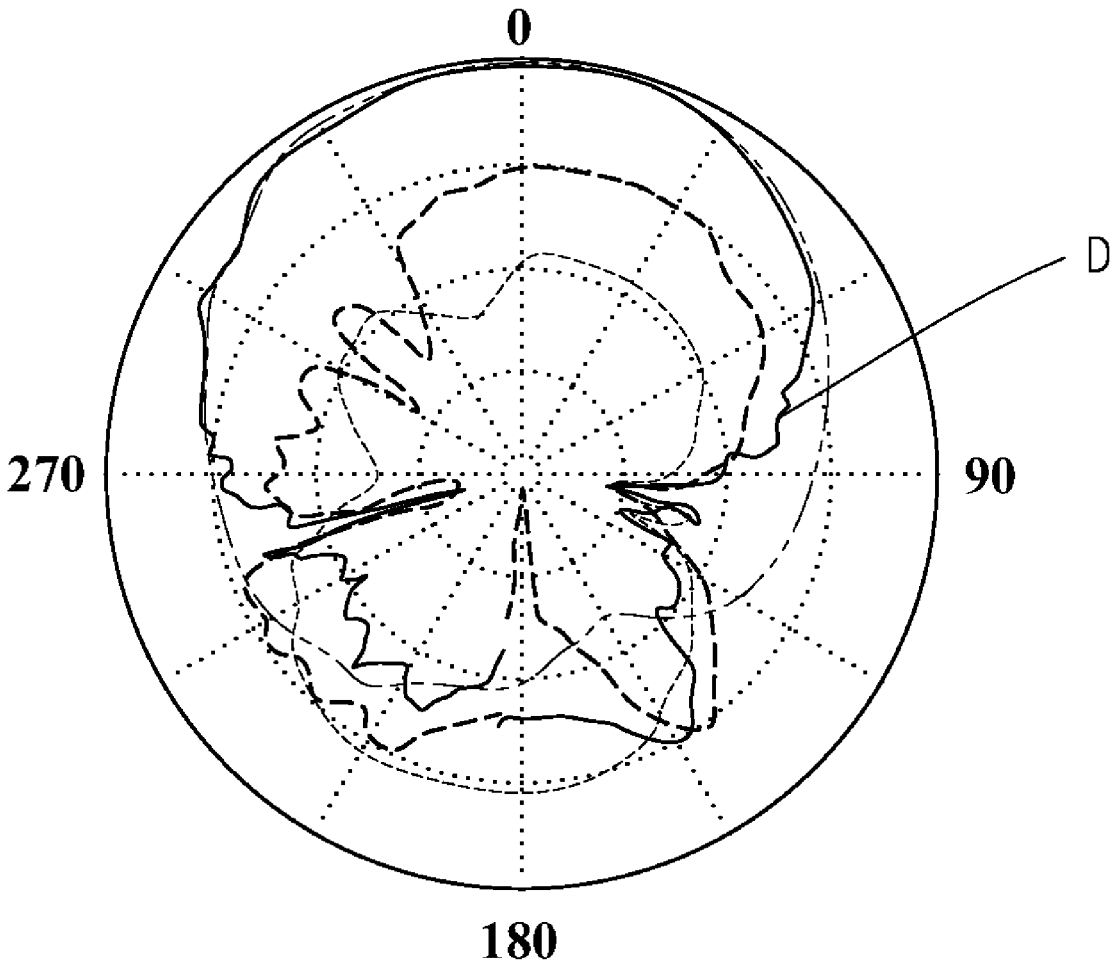
FIGS. 5A to 5D are radiation pattern diagrams of the circularly-polarized DRA according to the embodiment of the present invention.
Figure 5B:
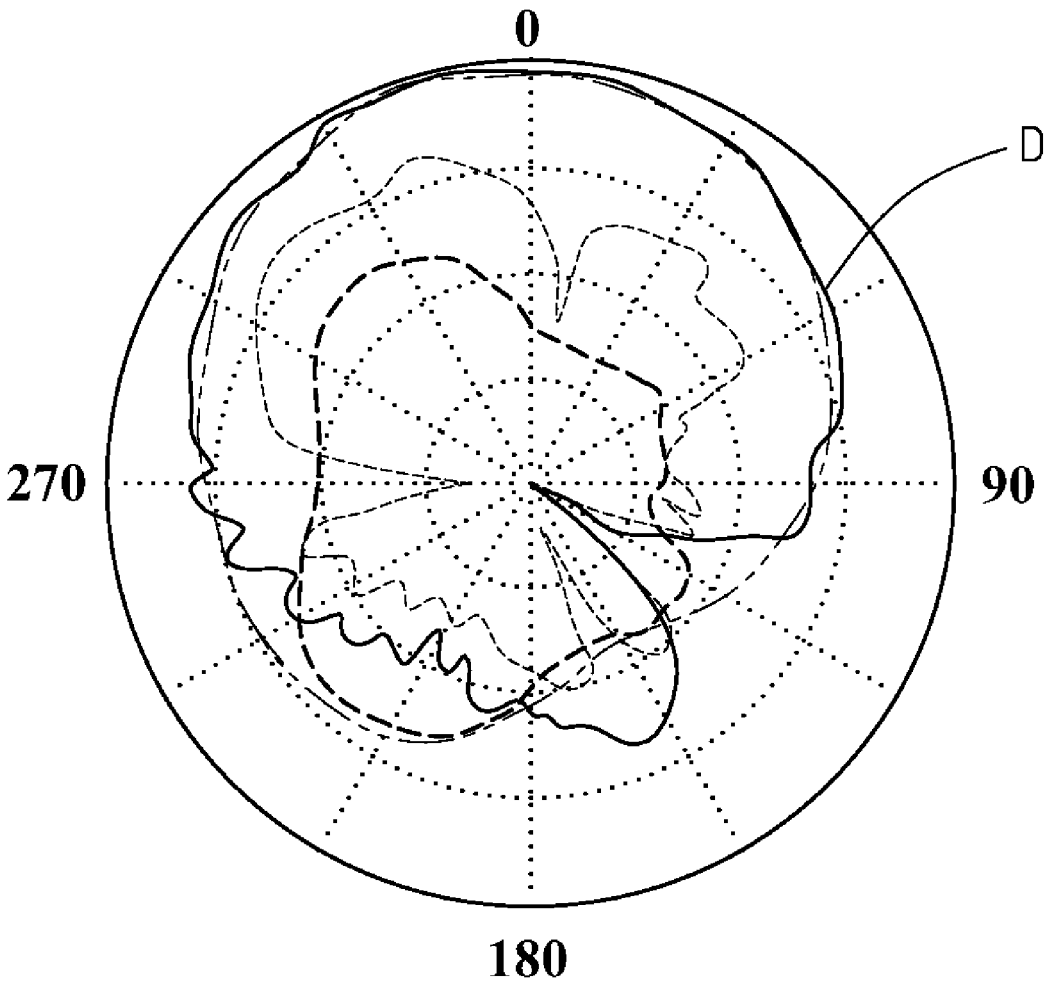
Figure 5C:
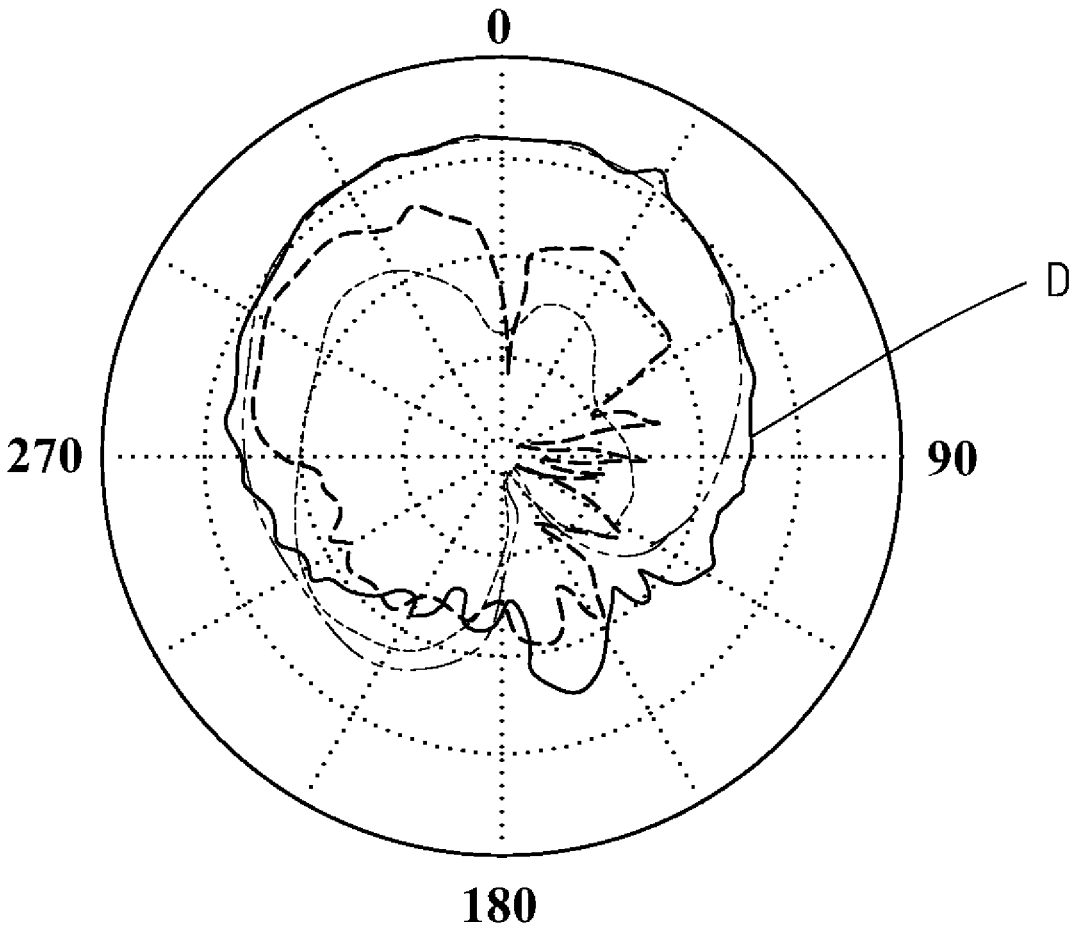
Figure 5D:
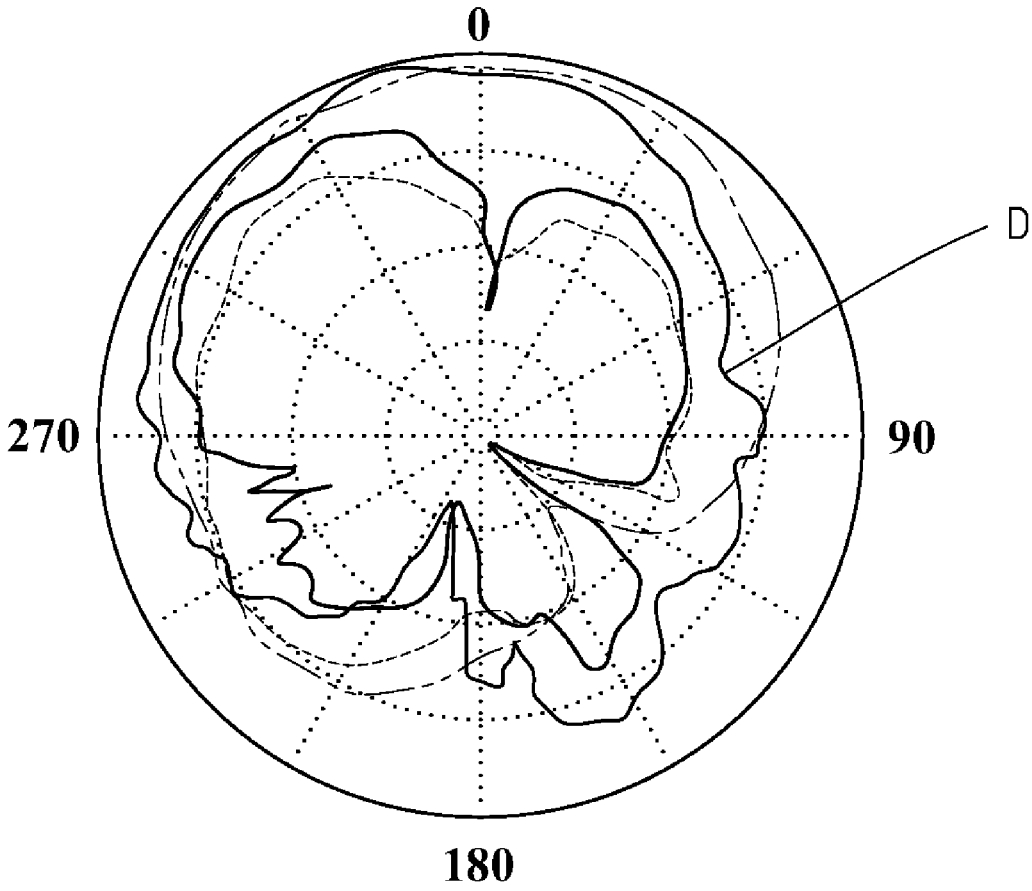

Next, referring to FIG. 4, a radiation performance diagram of the antenna according to the embodiment of the present invention is shown, in which the solid line represents the result of practically measuring AR C, the dashed line represents the result of simulating the AR, and broken line and point broken line are respectively measured and simulated antenna directivity. It can be observed from the drawing that when the AR is smaller than or equal to 4 dB, the return loss is smaller than 10 dB, the bandwidth is between 4.4 GHz and 5.35 GHz. When the return loss is smaller than 10 dB and the AR is smaller than 3 dB, the bandwidth is between 4.7 GHz and 5.2 GHz.

Referring to FIGS. 5A to 5D, radiation pattern diagrams of the embodiment of the present invention are shown. FIGS. 5A to 5D sequentially represent radiation patterns of the embodiment of the present invention in an xy plane at a frequency of 4.5 GHz, 4.8 GHz, 5 GHz, and 5.2 GHz respectively, in which the solid line is the measurement of the left-hand circular polarization D, and the dashed line is the measurement of the right-hand circular polarization.

While the invention has been particularly shown and described with reference to the preferred embodiments thereof, these are merely examples to help clarify the invention and are not intended to limit the invention. It will be understood by those skilled in the art that various changes, modifications, and alterations in form and details may be made therein without departing from the spirit and scope of the invention, as set forth in the following claims.

What is claimed is:

1. A circularly-polarized dielectric resonator antenna (DRA), comprising:

a substrate, including a first surface and a second surface;

a Wilkinson power divider, formed on the first surface;

a phase shifter, formed on the first surface and having a main line, a reference line, a first microstrip line, and a second microstrip line, wherein the main line and the reference line are respectively connected to two output ports of the Wilkinson power divider, and the first microstrip line and the second microstrip line are respectively connected to the main line and the reference line;

a ground plane, formed on the second surface and comprising a first hollow portion and a second hollow portion; and a dielectric resonator, including a main body and a slot, disposed above the ground plane.

2. The circularly-polarized DRA as claimed in claim 1, wherein the antenna further comprises a signal input/output device disposed on a side edge of the substrate.

3. The circularly-polarized DRA as claimed in claim 1, wherein the dielectric resonator is disposed above the first hollow portion and the second hollow portion.

4. The circularly-polarized DRA as claimed in claim 1, wherein the main body of the dielectric resonator is a square or rectangular structure.

5. The circularly-polarized DRA as claimed in claim 1, wherein the slot of the dielectric resonator is annular rectangular shaped.

6. The circularly-polarized DRA as claimed in claim 1, wherein the dielectric constant of the dielectric resonator is between 10 and 100.

7. The circularly-polarized DRA as claimed in claim 1, wherein the first microstrip line and the second microstrip line are respectively extended to pass through centers of the first hollow portion and the second hollow portion.

8. The circularly-polarized DRA as claimed in claim 1, wherein axes of the first hollow portion and the second hollow portion are orthogonal.

* * * * *